US012502586B2

(12) United States Patent
Kilburn

(10) Patent No.: US 12,502,586 B2
(45) Date of Patent: Dec. 23, 2025

(54) SPORTS GRIP ALIGNMENT DEVICE

(71) Applicant: Idlewild Company LLC, Bradford, TN (US)

(72) Inventor: Brandon Kilburn, Bradford, TN (US)

(73) Assignee: Idlewild Company LLC, Bradford, TN (US)

( * ) Notice: Subject to any disclaimer, the term of this patent is extended or adjusted under 35 U.S.C. 154(b) by 0 days.

(21) Appl. No.: 18/981,408

(22) Filed: Dec. 13, 2024

(65) Prior Publication Data

US 2025/0195972 A1 Jun. 19, 2025

Related U.S. Application Data

(63) Continuation-in-part of application No. 18/542,275, filed on Dec. 15, 2023, now abandoned.

(60) Provisional application No. 63/589,726, filed on Oct. 12, 2023.

(51) Int. Cl.

| | |
|---|---|
| ***A63B 60/10*** | (2015.01) |
| ***A63B 60/14*** | (2015.01) |
| ***A63B 102/18*** | (2015.01) |

(52) U.S. Cl.

CPC ..... *A63B 60/10* (2015.10); *A63B 60/14* (2015.10); *A63B 2102/18* (2015.10); *A63B 2102/182* (2015.10)

(58) Field of Classification Search

CPC ..... A63B 60/10; A63B 60/14; A63B 2102/18

See application file for complete search history.

(56) References Cited

U.S. PATENT DOCUMENTS

| | | | | |
|---|---|---|---|---|
| 5,482,270 | A | 1/1996 | Smith | |
| 5,795,242 | A * | 8/1998 | Ree | A63B 60/14 473/303 |
| 6,652,941 | B1 | 11/2003 | Chadwick | |
| 6,752,731 | B1 | 6/2004 | Kramer | |
| 7,351,167 | B1 | 4/2008 | Hathaway | |
| 10,046,215 | B2 | 8/2018 | Eastman | |
| 10,537,775 | B1 * | 1/2020 | Davis | A63B 53/14 |
| 10,912,972 | B1 * | 2/2021 | Fortin | A63B 60/14 |
| 11,291,896 | B1 * | 4/2022 | Cox | A63B 69/0002 |
| 2007/0254753 | A1 | 11/2007 | Bleecker | |
| 2016/0193512 | A1 * | 7/2016 | Wills | A63B 57/20 29/434 |
| 2017/0239541 | A1 * | 8/2017 | Eastman | A63B 53/14 |

* cited by examiner

*Primary Examiner* — Eugene L Kim
*Assistant Examiner* — Christopher Glenn

(57) ABSTRACT

A sports grip alignment device for swinging sports devices is described, such as for a baseball/softball bat, golf club, tennis racket, etc. The alignment device promotes an efficient swing by assuring a consistent grip. An implementation may be secured to the sports device. A rod may extend from a knob end to a barrel end distal from the knob end, the knob end tapering in from an inner side, a right side, and a left side to a point, the barrel end forming a semicircle from the right side to the left side. An implementation may include a convex outer side and a concave inner side extending along the length of the rod. A plurality of knobs may be distributed along the length of the convex outer side. A plurality of slots may be distributed along a portion of the length nearest the knob end in the concave inner side.

20 Claims, 4 Drawing Sheets

SPORTS GRIP ALIGNMENT DEVICE

CROSS REFERENCE TO RELATED APPLICATIONS

This patent application is a continuation-in-part of U.S. patent application Ser. No. 18/542,275 filed on Dec. 15, 2023, which claims the benefit of U.S. Provisional Patent Application 63/589,726 filed on Oct. 12, 2023, and this patent application incorporates the entire contents of all of the above referenced applications herein by reference.

BACKGROUND OF THE INVENTIONS

Knowing how to grip a baseball bat, or similar swinging sports device, is pivotal in making sure a batter gets the most out of his swing.

A powerful hit starts with the grip. The batter should always have a loose, relaxed grip, and make sure the bat is placed properly in the hands. To start properly placing the bat in the hands, grip the bat and line up the knuckles of each hand. From there, lower the top end of the bat to the ground while maintaining the grip. With the top end of the bat pointed down, open the palms of the hands and lay the bat across the pads of the fingers, where the fingers meet the hand.

Another checkpoint to use is to take the regular grip and then point the index fingers. If the index fingers are straight up and down or even in a "V", then the batter is gripping the bat correctly. When the batter grips the bat too far into the palms, the index fingers will point in opposite directions. If the batter is gripping the bat in the palms of the hands, the batter will lose bat speed and bat control. These simple guidelines make sure that the hands are aligned correctly for a home run swing.

It's important for a batter to master the basics. A good grip on the bat can help get the most out of the swing of the bat. These instructions are difficult to remember and train a batter. The proper grip on the bat results in a mechanically efficient swing by allowing the user's joints and muscles to operate in the most effective manner. Thus, bat speed and extended bat path are maximized.

There is a need to assist a batter in the proper placement of their hands on a bat with the same comfort and design they are accustomed to, with a seamless, low-profile feel.

SUMMARY OF THE INVENTIONS

Herein presented is a grip alignment device for a swinging sports device, such as a baseball/softball bat, golf club, tennis racket, etc. that can be secured to the sports device handle with an adhesive backing. The grip alignment device promotes an efficient swing of the sports device by assuring that the user has a consistent grip with every swing. A grip alignment device implementation may be sized to fit the swinging sports device, and may be long and thin, perhaps 25-30 times longer than the width, and about half as high as wide with nine evenly spaced raised marker knobs/bumps of about a third higher than the height with a diameter about ten percent of the width. The grip alignment device may be made of a flexible material (rubber, plastic, etc.) that attaches to the handle of the sports device with an adhesive backing with a concave designed surface to ensure a secure fit. The grip alignment device may be taped to the sports device. The grip alignment device is wedge-shaped to strategically align the hands (knuckles, distal interphalangeal joints, proximal interphalangeal joints) of the user with raised knobs (bumps) placed on the spine of the grip alignment device to allow for precise lateral placement of hands.

The above-described and other features and advantages realized through the techniques of the present disclosure will be better appreciated and understood with reference to the following detailed description, drawings, and appended claims. Additional features and advantages are realized through the techniques of the present inventions. Other embodiments and aspects of the inventions are described in detail herein and are considered a part of the claimed inventions.

BRIEF DESCRIPTION OF THE DRAWINGS

The subject matter that is regarded as the inventions is particularly pointed out and distinctly claimed in the claims at the conclusion of the specification. The foregoing and other objects, features, and advantages of the inventions are apparent from the following detailed description of exemplary embodiments of the present inventions taken in conjunction with the accompanying drawings.

Figure 1:
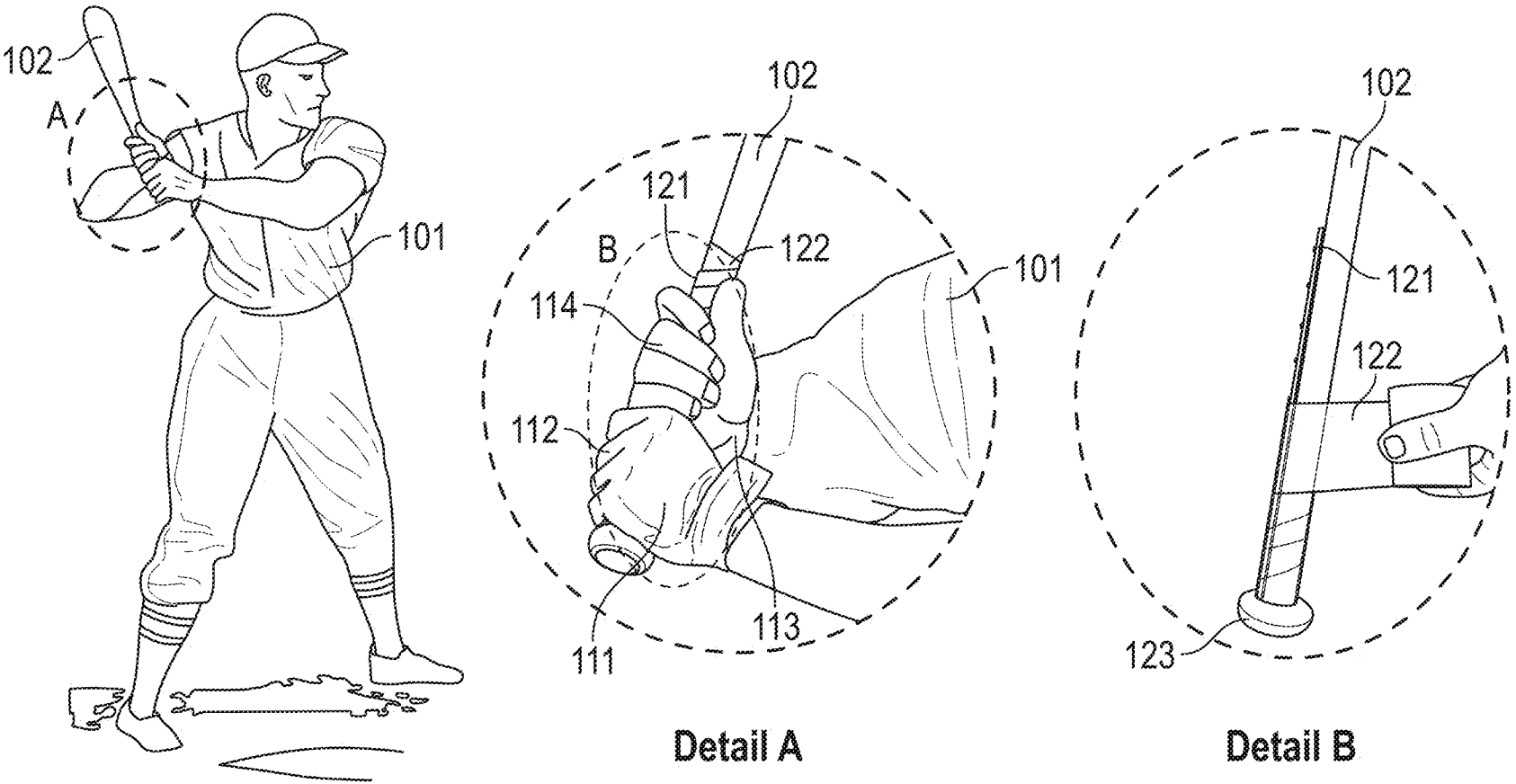
FIG. 1 is a diagram of the sports grip alignment device on the baseball bat embodiment.

The detailed description explains exemplary embodiments of the present inventions, together with advantages and features, by way of example with reference to the drawings, in which similar numbers refer to similar parts throughout the drawings. Any flow diagrams depicted herein are just examples. There may be many variations to these diagrams, or the steps (or operations) described therein without departing from the spirit of the inventions. For instance, the steps may be performed in a differing order, or steps may be added, deleted, or modified. All these variations are considered to be within the scope of the claimed inventions.

Like reference symbols in the various drawings indicate like elements.

DETAILED DESCRIPTION

While the specification concludes with claims defining the features of the inventions that are regarded as novel, it is believed that the inventions will be better understood from a consideration of the description of exemplary embodiments in conjunction with drawings. It is of course to be understood that the embodiments described herein are merely exemplary of the inventions, which can be embodied in various forms. Therefore, specific structural and functional details disclosed in relation to the exemplary embodiments described herein are not to be interpreted as limiting, but merely as a representative basis for teaching one skilled in the art to variously employ the present inventions in virtually any appropriate form, and it will be apparent to those skilled in the art that the present inventions may be practiced without these specific details. Further, the terms and phrases used herein are not intended to be limiting but rather to provide an understandable description of the inventions.

As described above, herein presented is a sports grip alignment device. The sports grip alignment device allows a user to consistently grip a handle of a swinging sports device in a precise manner. The design is a wedge-shape to strategically align the hands (knuckles, distal interphalangcal joints, proximal interphalangeal joints) of the user with evenly spaced raised knobs placed on the spine of the sports grip alignment device at the top of the wedge to allow for precise lateral placement of hands. The sports grip alignment device may comprise a flexible material (rubber, plastic, etc.) that attaches to the handle of the swinging sports device (e.g., baseball/softball bat) with an adhesive backing. The sports grip alignment device may be designed with a concave surface to ensure a secure fit to a swinging sports device handle. Once secured into place on the shaft of sports equipment, the sports grip alignment device is covered by either grip tape or grip of choice to provide the user the same comfort and design they are accustomed to, with a seamless, low-profile feel. The sports grip alignment device may be designed using flexible technology that allows it to fit sports equipment handles with varying contours, sizes, and shapes, including a series of slots along the side edges of the device to allow a solid fit to the swinging sports device. An exemplary sports grip alignment device may be flexible lengthwise and rigid relative to the circumference of the bat. The sports grip alignment device may be installed under-tape (or under-grip) of the swinging sports device to allow for a slim profile and increased control of the handle that keeps the feel of handled sports equipment true for total user control.

FIG. 1 illustrates a scenario of the sports grip alignment device 121 in use with a baseball bat embodiment. Batter 101 holds a baseball bat 102 in this scenario. When the bat 102 is properly gripped by the batter 101, the bat speed will be quicker, the batter 101 will be more relaxed, and the bat will be in a stronger position when the bat 102 makes contact with a baseball. With the speed of the baseball, without a strong grip, the bat will actually slow down or bounce off the ball at contact, resulting in weaker contact. With a proper grip, the bat 102 will drive through the baseball.

Details on the proper grip are shown in FIG. 1, DETAIL A. For a right-handed batter 101, the left hand 111 is on the bottom of the bat 102, near the knob 123. The right hand 113 is above the left hand 111 on the bat 102. When properly gripped, the left knuckles 112 (specifically, the proximal interphalangeal joints) of the left hand 111 are in line with the right knuckles 114 (the proximal interphalangcal joints) of the right hand 113. For a left-handed batter, the left hand 111 and right hand 113 are swapped on the bat 102.

FIG. 1, DETAIL B shows the sports grip alignment device 121 as tape 122 is applied to the bat 102. The sports grip alignment device 121 is placed against the knob 123 along the handle of the bat 102. Tape 122 is applied over the bat 102 handle and over the sports grip alignment device 121. When installed, the sports grip alignment device 121 creates a ridge under the tape 122 along the handle of the bat 102. For the batter 101, the ridge created by the sports grip alignment device 121 naturally causes the left hand 111 to grip the bat 102 with the left knuckles 112 over the ridge. Similarly, the right hand 113 is set so the right hand 113 is positioned with the right knuckles 114 over the ridge created by the sports grip alignment device 121. Thus, the left knuckles 112 are aligned with the right knuckles 114, and the grip on the bat 102 is optimal.

Figure 2:
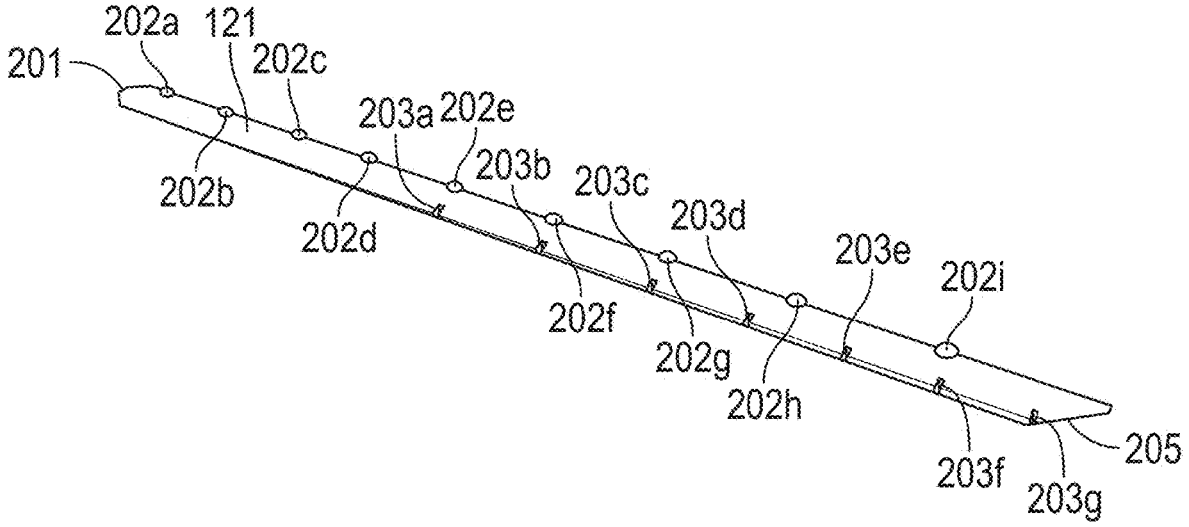
FIG. 2 is a perspective view of the sports grip alignment device.

FIG. 2 is a perspective view of the sports grip alignment device 121. The sports grip alignment device 121 is made up of a long narrow rod approximately 229-305 mm long, 9.5 mm wide, and 5 mm high. The rod has a knob end 205 and a barrel end 201. The rod could have a convex outer side and a concave inner side extending the length of the rod. The convex outer side could be curved with an apex at the top. Alternatively, two rectangular surfaces, 6 mm from the apex to the side edge, could meet at an apex, forming a triangle (or wedge shape). The apex could start at 8 mm in from the barrel end 201 and end at the very end of the knob end 205. The concave side could be semicircular. This radius could be the same radius as the handle of a bat 102. In some embodiments, the radius of the semicircle is 12 mm. The rod could be flexible and could be made of rubber or plastic (such as acrylonitrile butadiene styrene (ABS)). In some embodiments, the concave side may include an adhesive. The adhesive could create a mechanical union with the bat 102. The adhesive could be rubber.

The knob end 205 of the sports grip alignment device 121 may be located at one end of the rod. The knob end 205 of the rod could be on the end of the sports grip alignment device 121 that is installed against the knob 123 of the bat 102. The knob end 205 could taper from the two sides and bottom of the sports grip alignment device 121 to a point at the apex. The tapering may start about 9 mm from the end of the rod.

At the other end of the sports grip alignment device 121 is the barrel end 201. The barrel end 201, in one embodiment, is rounded down from the apex, forming a one-quarter oblate spheroid. The oblate spheroid has a 4.25 mm radius on the height and the width dimensions and a 9 mm length from the end of the rod to the beginning of the curvature for the barrel end 201.

In one embodiment, there are nine raised cylindrical marker knobs/bumps 202*a-i* of 1.6 mm high and 1 mm in diameter spaced 25 mm apart on the top of the apex of the sports grip alignment device 121. The diameter or width of an exemplary marker knob/bump may be up to 2 mm. The height of an exemplary marker knob/bump may be up to 3 mm. An effective range of marker knob/bump height for encouraging optimal knuckle alignment is between 1-3 mm. The raised cylindrical marker knobs/bumps 202*a-i* could start 20 mm from the barrel end 201. The raised cylindrical marker knobs/bumps 202*a-i* could end 23 mm from the knob end 205. If the sports grip alignment device 121 is longer, the raised cylindrical marker knobs/bumps 202*a-i* could be further apart than 25 mm or additional raised cylindrical marker knobs/bumps 202*a-i* could be added to the apex. While some embodiments have the raised cylindrical marker knobs/bumps 202*a-i* evenly spaced, some embodiments may use an uneven spacing. Some embodiments could use half-sphere-shaped raised marker knobs/bumps 202*a-i*; other embodiments may use a cuboid shape, a rhombohedron shape, or other similar shapes. The raised cylindrical marker knobs/bumps 202*a-i* provide the batter 101 with a reference on where to place the fingers of his left hand 111 and right hand 113 on the bat 102 relative to the knob 123 along the handle of the bat 102.

In one embodiment, the sports grip alignment device 121 has a plurality of slots 203*a-g*,204*a-g*, seven on each side. These slots 203*a-g*,204*a-g* provide flexibility to ensure a proper fit between the sports grip alignment device 121 and the bat 102 across a wide range of bat 102 sizes and shapes.

In the depicted implementation the slots 203*a-g*,204*a-g* are disposed along only a portion of the sports grip alignment device 121. In the illustrated implementation the slots 203*a-g*,204*a-g* are located only in the portion of the sports grip alignment device 121 proximal to the knob end 205. Locating the slots 203*a-g*,204*a-g* proximal to the knob end 205 permits the sports grip alignment device 121 knob end 205 to flex in the plane of the bat 102 longitudinal axis as the grip alignment device 121 is pressed into the knob 123 of the bat 102. In the depicted implementation the sports grip alignment device 121 knob end 205 has a taper from the bottom to the top (depicted at least by FIGS. 3C and 3D). Permitting the sports grip alignment device 121 tapered knob end 205 to flex provides a firmer fit to bat 102 knobs with increasingly aggressive angles closer to the knob 123. The slots 203*a-g*,204*a-g* may be positioned incrementally closer to each other to allow for greater flexibility toward the knob end 205, to accommodate the contour of a bat 102 into the knob 123, and provide a tighter fit. With a better fit, the adhesion between the sports grip alignment device 121 and the bat 102 is improved, to secure the sports grip alignment device 121 more firmly against the knob 123 of the bat 102. Securing the sports grip alignment device 121 more firmly against the knob 123 of the bat 102 prevents the sports grip alignment device 121 from moving along the bat 102 longitudinal axis, even from repeated strong impact and shear stress cycles resulting from use by powerful batters. In one embodiment, there are seven slots 203*a-g*,204*a-g* unevenly spaced at the knob end 205 of the sports grip alignment device 121. The slots 203*a-g*,204*a-g* could be 1 mm wide and 2.5 mm deep from the side of the sports grip alignment device 121. The slots 203*a-g*,204*a-g* could be mirrored on each side of the sports grip alignment device 121. In one embodiment, the first slots 203*g*,204*g* are located 10 mm from the knob end 205. The second slots 2031,204*f* are located 23 mm from the knob end 205. The third slots 203*c*,204*e* are located 37 mm from the knob end 205. The fourth slots 203*d*,204*d* are located 54 mm from the knob end 205. The fifth slots 203*c*,204*c* are located 72 mm from the knob end 205. The sixth slots 203*b*,204*b* are located 98 mm from the knob end 205. The seventh slots 203*a*,204*a* are located 126 mm from the knob end 205. In other embodiments, the slots 203*a-g*, 204*a-g* could be evenly spaced, either at one end or evenly spaced over the entire sports grip alignment device 121. In some embodiments, more (or less) than seven slots 203*a-g*, 204*a-g* per side could be used.

Figure 3A:
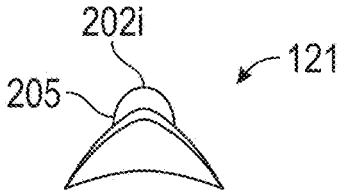
FIG. 3A is a front view of the sports grip alignment device, from the knob side reference point.

FIG. 3A shows a front view of the sports grip alignment device 121 from the knob end 205. From this view, the concave bottom surface of the sports grip alignment device 121 can be seen. The concave side could be semicircular with a 12 mm radius. The last raised marker knobs/bump 202*i* is visible from this view. This embodiment shows the last raised marker knobs/bump 202*i* as a half sphere. The tapering of the knob end 205 to a point is visible.

Figure 3B:
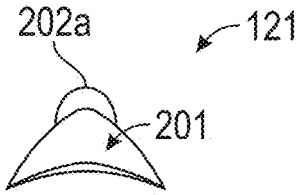
FIG. 3B is a back view of the sports grip alignment device.

FIG. 3B shows a back side view of the sports grip alignment device 121 from the barrel end 201. The concave bottom surface can be seen, and the barrel end's 201 one-quarter oblate spheroid is apparent. The first raised marker knobs/bump 202*a* is visible from this view. This embodiment shows the first raised marker knobs/bump 202*a* as a half sphere.

Figure 3C:
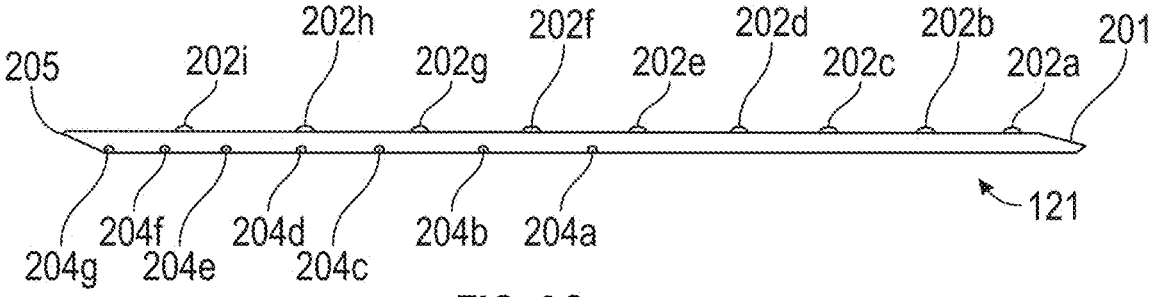
FIG. 3C is a right-side view of the sports grip alignment device.

FIG. 3C is a right-side view of the sports grip alignment device 121. The knob end 205 has a taper from the bottom to the top. The raised spherical marker knobs/bumps 202*a-i* are evenly spaced across the top of this view. The spacing could be every 25 mm starting 23 mm from the knob end 205 and ending 28 mm from the barrel end 201. Other embodiments may have a different number of raised cylindrical marker knobs/bumps 202*a-i* or different spacing. The embodiment depicted by FIG. 3C uses raised cylindrical marker knobs/bumps 202*a-i* as half spheres. In other embodiments, the knobs/bumps 202*a-i* may be cylinders, cuboids, rhombohedrons, or other similar shapes.

Slots 204*a-g* may be spaced with an increasing distance between the slots, a spacing that could be calculated with a second-degree polynomial as (where x is the slot number and distance is in mm from the knob end 205):

$$\text{distance} = 1.6x^2 + 6x + 3.4$$

The shape of the slots 204*a-g* could be semicircular, 1 mm in diameter. In another embodiment, the slots 204*a-g* could be square 1 mm high and 1 mm wide. In this embodiment, there are seven slots, and the slots 204*a-g* are located on the knob end 205 end of the sports grip alignment device 121. The slots allow flexibility as the sports grip alignment device 121 bends to conform with the shape of the handle of the bat 102.

The barrel end 201 could be a 10 mm line from the apex to the bottom of the sports grip alignment device 121. In another embodiment, the barrel end 201 could be a one-quarter oblate spheroid. In still another embodiment, the barrel end 201 could be a squared end of the sports grip alignment device 121.

Figure 3D:
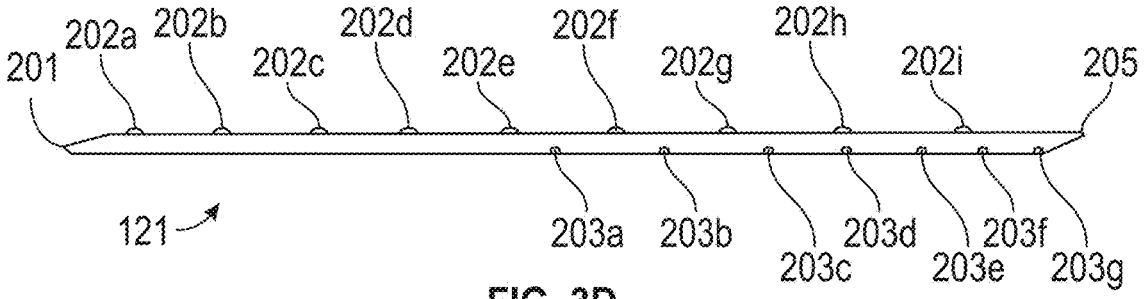
FIG. 3D is a left-side view of the sports grip alignment device.

FIG. 3D shows the left-side view of the sports grip alignment device 121, showing the barrel end 201, the knob end 205, and the raised cylindrical marker knobs/bumps 202*a-i* from the opposite side. Slots 203*a-g* are shown. Slots 203*a-g* may be spaced with an increasing distance between the slots, a spacing that could be calculated with a second-degree polynomial as (where x is the slot number and distance is in mm from the knob end 205):

$$\text{distance} = 1.6x^2 + 6x + 3.4$$

The shape of the slots 203*a-g* could be semicircular, 1 mm in diameter. In another embodiment, the slots 203*a-g* could be square 1 mm high and 1 mm wide. In this embodiment, there are seven slots, and the slots 203*a-g* are located on the knob end 205 end of the sports grip alignment device 121. Slots 203*a-g* mirror slots 204*a-g* on the other side of the sports grip alignment device 121. The slots allow flexibility as the sports grip alignment device 121 bends to conform with the shape of the handle of the bat 102.

Figure 3E:
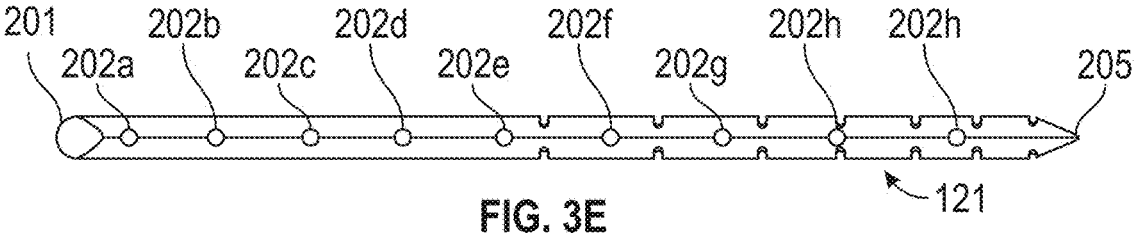
FIG. 3E is a top view of the sports grip alignment device.

FIG. 3E shows the top view of the sports grip alignment device 121. The barrel end 201 is located on one end and may be a 9 mm diameter semicircle from the bottom of the sports grip alignment device 121 with the sides sloping or curving towards the edge of the barrel end 201. The knob end 205 is located at the other end of the sports grip alignment device 121. In one embodiment, the edges of the sports grip alignment device 121 slope upward to the apex at the knob end 205, forming a point. The raised cylindrical marker knobs/bumps 202*a-i* are spaced evenly, in this embodiment, along the apex of the sports grip alignment device 121.

Figure 3F:
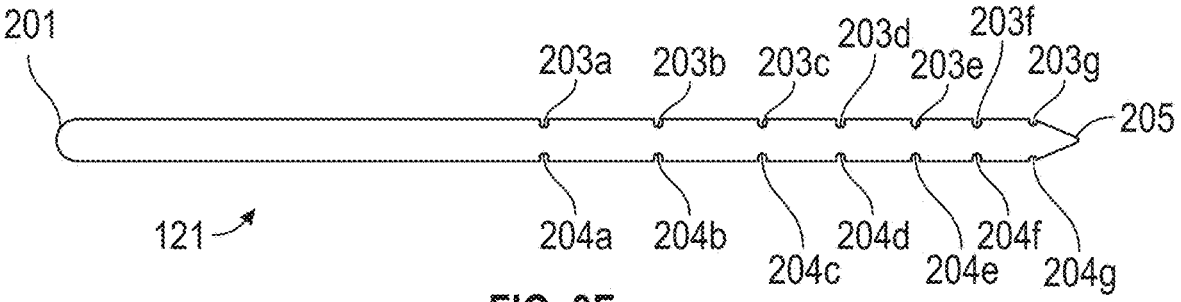
FIG. 3F is a bottom view of the sports grip alignment device.

FIG. 3F is a bottom view of the sports grip alignment device 121. The barrel end 201 is seen as a 9 mm diameter semicircle, although this could be a straight-line rectangle end or a triangular end in other embodiments. The knob end 205 is on the other end of the sports grip alignment device 121 and could be triangular in shape. In other embodiments, the knob end 205 could be a straight-line rectangular end or semicircular. Slots 203*a-g*,204*a-g* could be 2 mm deep and 1 mm wide. In some embodiments, these slots 203*a-g*, 204*a-g* could have a semicircular end. In other embodiments, the slots 203*a-g*,204*a-g* could have a squared end (or squared end with rounded corners). There are seven slots in one embodiment, located on the knob end 205 of the sports grip alignment device 121. Slots 203*a-g*, 204*a-g* may be spaced with an increasing distance between the slots, a spacing that could be calculated with a second-degree polynomial as (where x is the slot number and distance is in mm from the knob end 205):

$$\text{distance} = 1.6x^2 + 6x + 3.4$$

The bottom surface of the sports grip alignment device 121 could have an adhesive installed on it. In one embodiment, the bottom of the sports grip alignment device 121 has a tape-like adhesive, with a protective covering installed. The protective covering may be removed to expose the adhesive before adhering the sports grip alignment device 121 to the bat 102.

Figure 4:
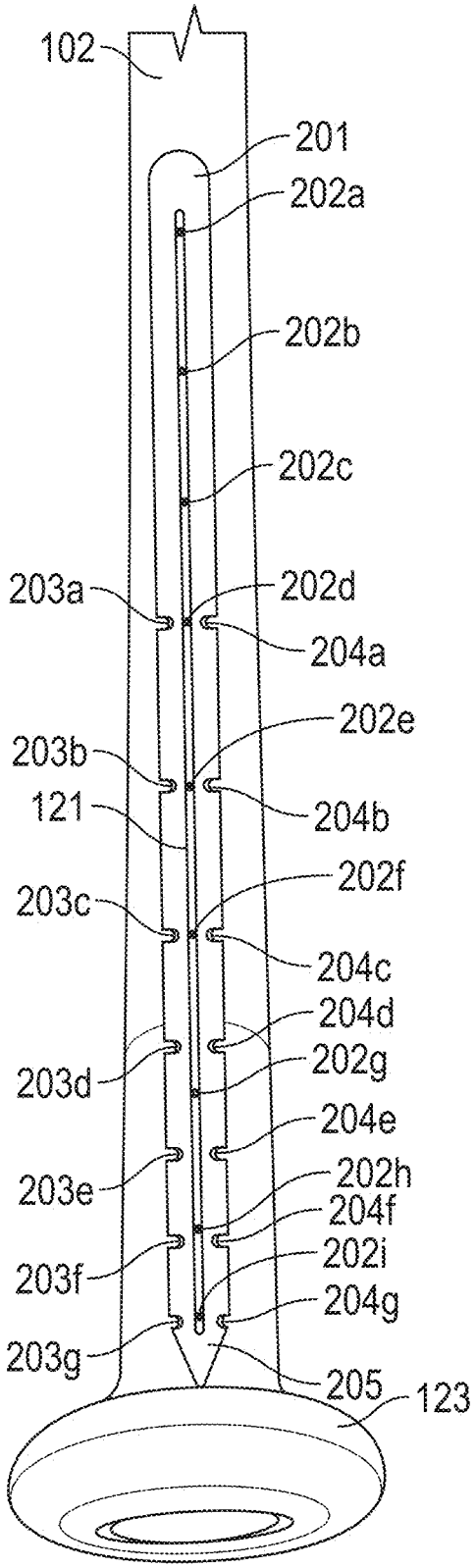
FIG. 4 is a view of the sports grip alignment device installed on a baseball bat.

FIG. 4 shows the sports grip alignment device 121 installed on the bat 102. The knob end 205 is placed against the knob 123 of the bat 102, and the sports grip alignment device 121 could be pressed against the handle section of the bat 102, causing an adhesive to attach. In some embodiments, tape 122 is then wrapped over the sports grip alignment device 121 and at least a portion of the bat handle. In other embodiments, the sports grip alignment device 121 is at least partially covered by a baseball bat grip.

Although various embodiments have been described with reference to the Drawings, other embodiments are possible. For example, the sports grip alignment device 121 could be used with any swinging sports device, such as a tennis racket, golf club, softball bat, hockey stick, field hockey stick, lacrosse stick, ski poles, cricket stick, ping pong paddle or pickleball paddles in addition to the bat 102.

It is an object of the present disclosure to teach a sports grip alignment device that encourages optimal alignment of the user's Proximal Interphalangeal (PIP) joints in a two-handed grip while maximizing the surface contact area between the fingers and the sports device. As discussed above an effective range of marker knob/bump height from 1-3 mm high has been discovered by the Applicant to be optimal for encouraging knuckle alignment in sports grips. In an illustrative example, the marker knobs/bumps provide a user with a reference for where to place the fingers of their hands on a baseball bat to align their knuckles. One of ordinary skill will appreciate that a baseball batter picking up a bat will first align their knuckles to encourage their hands to swing as a unit and then tighten their grip to prevent the bat from slipping or rotating in their hands. One of ordinary skill will appreciate that a baseball batter will align their knuckles on the bat to cause their two hands to work as a unitary gripping device. The effective baseball batter will grip the bat tightly enough to prevent the bat from rotating within the batter's hands.

In an illustrative example, an exemplary sports grip alignment device comprises a plurality of marker knobs/bumps distributed along a ridge. The ridge design may comprise a wedge-shape to strategically align the hands (knuckles, distal interphalangeal joints, proximal interphalangeal joints) of the user with raised marker knobs/bumps disposed on the spine to allow for precise placement of hands. The ridge and marker knobs/bumps may be sized to fit under the user's fingers. For example, the ridge may be wedge-shaped as depicted at least by FIGS. 3A-3B. The wedge-shaped ridge may be sized to fit under a user's finger in the crease that is present underneath a human knuckle. In this example, each finger has a PIP Joint approximately in the middle of each finger except thumbs. The wedge-shaped ridge of the present alignment device may be sized and shaped to fit in the creases under a plurality of PIP joints, to align the PIP joints for effective batting as discussed above. In a typical human, creases under the PIP joints may have depths of up to 5 mm and widths of up to 3 mm, depending on a degree of articulation or bending of the finger. In an illustrative example, raised marker knobs/bumps having a height of up to 3 mm may be disposed on the spine of the sports grip alignment device to provide a user with a reference on where to place the fingers of their hands on a baseball bat to optimally align their knuckles. Optimal knuckle alignment will be appreciated by one of ordinary skill as highly advantageous to a baseball batter.

In this example, a user's fingers gripping a bat may be abutting another finger on either side. The marker knobs/bumps may be positioned and sized to fit into the double crease formed where two PIP joints of adjacent fingers come together. For example, a plurality of marker knobs/bumps having a height of up to 3 mm may provide a user with a reference point to position the PIP joints of two fingers, as a result of the marker knob/bump fitting into the depth of the double crease formed where the two PIP joints of adjacent fingers come together. In this example, the marker knob/bump height is in a range of up to 3 mm to maximize the surface contact area between the fingers and the sports device. The marker knob/bump height helps maximize surface contact area between the fingers and the sports device at least because the marker knob/bump height of up to 3 mm fits into the depth of the double crease without protruding up between the fingers. If the marker/knob bumps were longer than this critical range of up to 3 mm, the longer marker knob/bump would force the user's fingers apart, degrading the user's grip by defeating the increased strength of the unitary gripping device that could be formed from optimally aligned knuckles of two hands. Marker knobs/bumps that were higher than this critical range of marker knob/bump height up to 3 mm may displace the user's fingers from contact with the baseball bat, reducing the surface contact area between the fingers and the bat. Since the gripping force is a function of engaged surface area, marker knobs/bumps higher than about 3 mm would reduce the effectiveness of a batter's grip. Furthermore, this critical range of marker knob/bump height up to 3 mm for encouraging alignment would not prevent rotation of the bat within the user's hands, at least because the marker knobs/bumps of up to 3 mm would not be long enough to protrude up and engage the sides of the fingers.

In an illustrative example, the height range for the marker knobs/bumps may be selected in a negative height range effectively becoming an indent to perform the marker function. This feature would have the advantage that indented markers would not protrude from the baseball bat handle. For example, the negative height range of the bumps (i.e., indents) may be for example −2.5 mm to +2.5 mm. The "marker" function of the device may be effectively served by an indent.

A sports grip alignment device 121 may comprise of rubber, wood, cardboard, fabric, ceramic, aluminum, steel, stainless steel, iron, bronze, brass, acrylonitrile butadiene styrene (ABS), polyethylene terephthalate (PET or PETE), high-density polyethylene (HDPE), polyvinyl chloride (PVC or Vinyl), low-density polyethylene (LDPE), polypropylene (PP), polystyrene (PS or Styrofoam), bisphenol, methyl methacrylate (PMMA), polybutylene terephthalate (PBT), and polyether ether ketone (PEEK), polyacetylene, high impact polystyrene (HIPS), polycarbonate (PC), urea-formaldehyde (UF), silicone, aramids, polyetherimide (PEI), polyimide, polysulfone, polytetrafluoroethylene (PTFE), polyamide-imide (PAI), or similar materials.

The tape 122 may comprise any form of athletic equipment tape or grip, such as friction tape, gripping tape, bat grip tape, hockey tape, crepe paper golf grip tape, pickleball grip tape, cricket bat grips, baseball bat grips, golf club grips, and similar.

The adhesive to adhere the sports grip alignment device 121 to the bat 102 may comprise a rubber adhesive, pitch, two-sided tape, water-based adhesives, solvent-based adhesives, reactive adhesives (polyurethane, acrylic, cyanoacrylate, polyimide, silicone, etc.), hot melt adhesives (hot glue, etc.), thermosetting adhesives (resin and hardener, etc.), pressure-sensitive adhesives, contact adhesives, epoxy adhesives, white glue (polyvinyl acetate), and similar.

In some embodiments, slots 203*a-g* could be fully connected with their counterpart slots 204*a-g* to form a "keyway", "channel", "groove", or "hinge-point" across the entire bottom of the device. For example, the slots 203*a-g* may have a depth that intercepts the depth of the slots 204*a-g*, forming individual "keyways", "channels", "grooves" or "hinge-points." In some embodiments, the "keyway", "channel", "groove", or "hinge-point" may be about 0.5 mm to 1 mm wide and 2 mm-3 mm high across the entire underside (bottom) of the device to create a hinge that promotes maximum flexibility. The shape of the "keyway", "channel", "groove", or "hinge-point" may be a triangle, a semicircle, a square or similar shape. In some embodiments, these "hinges" could allow the sports grip alignment device 121 to be rolled into a circle and packaged.

In some embodiments, the barrel end 201 and the knob end 205 could be rectangular in shape to allow for a maximum amount of material so that a user could fashion their own desired end with a cutting instrument to create a custom detailed barrel end 201 and/or knob end 205 to their own preferred shape.

Implementation 1. A baseball bat grip alignment device comprising: a rod having a length extending from a knob end to a barrel end distal from the knob end, the knob end tapering in from an inner side, a right side, and a left side to a point, the barrel end forming a semicircle from the right side to the left side; a convex outer side and a concave inner side extending along the length of the rod; at least 6 bumps spaced 25 mm apart, wherein the at least 6 bumps have a span that extends about 125 mm along a portion of the length of the rod, wherein the at least 6 bumps are disposed inline on top of an apex at the top of the convex outer side, and wherein each bump of the at least 6 bumps comprises a bump top separated from the convex outer side by a bump height of 1.6 mm; and a plurality of slots, wherein each slot of the plurality of slots has an outer open edge and an enclosed inner edge, wherein each slot of the plurality of slots is located between at least a portion of the at least 6 bumps and distributed along a portion of the length nearest the knob end in the concave inner side, further wherein each slot of the plurality of slots traverses the rod from the convex outer side through the concave inner side.

Implementation 2. The baseball bat grip alignment device of implementation 1, wherein the rod is flexible.

Implementation 3. The baseball bat grip alignment device of implementation 1, wherein the rod is configured to be in mechanical union with a baseball bat and wherein the span of the at least 6 bumps is configured to align knuckles of at least 6 abutting fingers of a baseball batter's hands wrapped around a handle section of the baseball bat.

Implementation 4. The baseball bat grip alignment device of implementation 3, wherein the mechanical union is an adhesive.

Implementation 5. The baseball bat grip alignment device of implementation 3, wherein the concave inner side is semicircular with a same radius as the handle section of the baseball bat.

Implementation 6. The baseball bat grip alignment device of implementation 3, wherein the rod is at least partially covered by a grip secured to the baseball bat.

Implementation 7. The baseball bat grip alignment device of implementation 6, wherein the grip comprises tape wrapped around at least a portion of the baseball bat.

Implementation 8. The baseball bat grip alignment device of implementation 1, wherein the rod comprises a rubber material.

Implementation 9. The baseball bat grip alignment device of implementation 1, wherein the rod comprises acrylonitrile butadiene styrene material.

Implementation 10. The baseball bat grip alignment device of implementation 1, wherein the convex outer side is triangular.

Implementation 11. The baseball bat grip alignment device of implementation 1, wherein the at least 6 bumps are evenly spaced along the rod.

Implementation 12. The baseball bat grip alignment device of implementation 1, wherein the at least 6 bumps is spaced 25 mm apart.

Implementation 13. The baseball bat grip alignment device of implementation 1, wherein the at least 6 bumps are at least 6 cylinders.

Implementation 14. The baseball bat grip alignment device of implementation 13, wherein the at least 6 cylinders are 1.6 mm high and 1 mm in diameter.

Implementation 15. The baseball bat grip alignment device of implementation 1, wherein the at least 6 bumps are located at an apex of the convex outer side.

Implementation 16. The baseball bat grip alignment device of implementation 1, wherein the length is between 229 and 305 mm.

Implementation 17. The baseball bat grip alignment device of implementation 1, wherein a width of the rod is 9.5 mm.

Implementation 18. The baseball bat grip alignment device of implementation 1, wherein a height of the rod is 5 mm.

Implementation 19. The baseball bat grip alignment device of implementation 1, wherein the plurality of slots are 2 mm deep into the convex outer side and 1 mm wide.

Implementation 20. The baseball bat grip alignment device of implementation 1, wherein the plurality of slots are spaced 16 mm apart.

In some aspects, the techniques described herein relate to a sports grip alignment device 121 including a rod having a length extending from a knob end 205 to a barrel end 201 distal from the knob end 205, the knob end 205 tapering in from an inner side, a right side, and a left side to a point, the barrel end 201 forming a semicircle from the right side to the left side; a convex outer side and a concave inner side extending along the length of the rod; a plurality of knobs 202*a-i* distributed along the length in the convex outer side; and a plurality of slots 203*a-g*,204*a-g* distributed along a portion of the length nearest the knob end 205 in the concave inner side.

In some aspects, the techniques described herein relate to a sports grip alignment device 121, wherein the rod is flexible.

In some aspects, the techniques described herein relate to a sports grip alignment device 121, wherein the rod is in mechanical union with a baseball bat 102.

In some aspects, the techniques described herein relate to a sports grip alignment device 121, wherein the mechanical union is an adhesive.

In some aspects, the techniques described herein relate to a sports grip alignment device 121, wherein the concave inner side is semicircular with a same radius as a handle section of the baseball bat 102.

In some aspects, the techniques described herein relate to a sports grip alignment device 121, wherein the rod is at least partially covered by a grip 122 secured to the baseball bat 102.

In some aspects, the techniques described herein relate to a sports grip alignment device 121, wherein the grip includes tape 122 wrapped around at least a portion of the baseball bat 102.

In some aspects, the techniques described herein relate to a sports grip alignment device 121, wherein the rod includes a rubber material.

In some aspects, the techniques described herein relate to a sports grip alignment device 121, wherein the rod includes acrylonitrile butadiene styrene material.

In some aspects, the techniques described herein relate to a sports grip alignment device 121, wherein the convex outer side is triangular.

In some aspects, the techniques described herein relate to a sports grip alignment device 121, wherein the plurality of knobs 202*a-i* is evenly spaced along the rod.

In some aspects, the techniques described herein relate to a sports grip alignment device 121, wherein the plurality of knobs 202*a-i* is spaced 25 mm apart.

In some aspects, the techniques described herein relate to a sports grip alignment device 121, wherein the plurality of knobs 202*a-i* are cylinders.

In some aspects, the techniques described herein relate to a sports grip alignment device 121, wherein the cylinders are 1.6 mm high and 1 mm in diameter.

In some aspects, the techniques described herein relate to a sports grip alignment device 121, wherein the plurality of knobs 202*a-i* is located at an apex of the convex outer side.

In some aspects, the techniques described herein relate to a sports grip alignment device 121, wherein the length is between 229 and 305 mm.

In some aspects, the techniques described herein relate to a sports grip alignment device 121, wherein a width of the rod is 9.5 mm.

In some aspects, the techniques described herein relate to a sports grip alignment device 121, wherein a height of the rod is 5 mm.

In some aspects, the techniques described herein relate to a sports grip alignment device 121, wherein the plurality of slots 203*a-g*,204*a-g* are 2 mm deep into the convex outer side and 1 mm wide.

In some aspects, the techniques described herein relate to a sports grip alignment device 121, wherein the plurality of slots 203*a-g*,204*a-g* are spaced 16 mm apart.

While various implementations have been disclosed and described in detail herein, it will be apparent to those skilled in the art that various changes may be made to the disclosed configuration, operation, and form without departing from the spirit and scope thereof. In particular, it is noted that the respective implementation features, even those disclosed solely in combination with other implementation features, may be combined in any configuration except those readily apparent to the person skilled in the art as nonsensical.

In the present disclosure, various features may be described as being optional, for example, through the use of the verbs "may" or "could;" or, through the use of any of the phrases: "in some implementations," "in some embodiments," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

Suitable methods and corresponding materials to make each of the individual parts of the implementation apparatus are known in the art. One or more implementation parts may be formed by machining, 3D printing (also known as "additive" manufacturing), CNC machined parts (also known as "subtractive" manufacturing), or injection molding, as will be apparent to a person of ordinary skill in the art. Metals, wood, thermoplastic and thermosetting polymers, resins, and elastomers as may be described herein-above may be used. Suitable materials are known and available and can be selected and mixed depending on desired strength and flexibility, preferred manufacturing method, and particular use, as will be apparent to a person of ordinary skill in the art.

In the Summary above, in this Detailed Description, the Claims below, the content of each of the applications incorporated by reference herein, and in the accompanying drawings, reference is made to features of various embodiments of the inventions. It is to be understood that the disclosure of embodiments of the inventions in this specification includes all possible combinations of such features. For example, where a particular feature is disclosed in the context of a particular aspect or embodiment of the inventions, or a particular claim, that feature can also be used—to the extent possible—in combination with and/or in the context of other aspects and embodiments of the inventions, and in the inventions generally.

Therefore, it is intended that the inventions not be limited to the particular embodiments disclosed as the best mode contemplated for carrying out these inventions, but that the inventions will include all embodiments falling within the scope of the present application as set forth in the following claims, wherein reference to an element in the singular, such as by use of the article "a" or "an" is not intended to mean "one and only one" unless specifically so stated, but rather "one or more." Moreover, no claim element is to be construed under the provisions of 35 U.S.C. § 112 (f) unless the element is expressly recited using the phrase "means for" or "step for." The following claims should be construed to maintain the proper protection for the present inventions.

What is claimed is:

1. A baseball bat grip alignment device comprising:

a rod having a length extending from a knob end to a barrel end distal from the knob end, the knob end tapering in from an inner side, a right side, and a left side to a point, the barrel end forming a semicircle from the right side to the left side;

a convex outer side and a concave inner side extending along the length of the rod;

at least 6 bumps spaced 25 mm apart, wherein the at least 6 bumps have a span that extends about 125 mm along a portion of the length of the rod, wherein the at least 6 bumps are disposed inline on top of an apex at the top of the convex outer side, and wherein each bump of the at least 6 bumps comprises a bump top separated from the convex outer side by a bump height of up to 2 mm; and a plurality of slots, wherein each slot of the plurality of slots has an outer open edge and an enclosed inner edge, wherein each slot of the plurality of slots is located between at least a portion of the at least 6 bumps and distributed along a portion of the length nearest the knob end in the concave inner side, wherein each slot of the plurality of slots traverses within the rod from the convex outer side through the concave inner side, and wherein the plurality of slots are separated from each other by a space having a distance, wherein the distance between the slots increases from the knob end to the barrel end, further wherein the distance of each space between the plurality of slots is calculated with the following equation:

$$\text{distance}=1.6x^2+6x+3.4$$

where x is the slot number and distance is in mm from the knob end.

2. The baseball bat grip alignment device of claim 1, wherein the rod is flexible.

3. The baseball bat grip alignment device of claim 1, wherein the concave inner side is semicircular with a same radius as the handle section of the baseball bat.

4. The baseball bat grip alignment device of claim 1, wherein the rod is at least partially covered by a grip secured to the convex outer side of the device.

5. The baseball bat grip alignment device of claim 4, wherein the grip comprises adhesive tape.

6. The baseball bat grip alignment device of claim 1, wherein the rod comprises a rubber material.

7. The baseball bat grip alignment device of claim 1, wherein the rod comprises acrylonitrile butadiene styrene material.

8. The baseball bat grip alignment device of claim 1, wherein the convex outer side is triangular.

9. The baseball bat grip alignment device of claim 1, wherein the at least 6 bumps are evenly spaced along the rod.

10. The baseball bat grip alignment device of claim 1, wherein the at least 6 bumps are spaced 25 mm apart.

11. The baseball bat grip alignment device of claim 1, wherein the at least 6 bumps are at least 6 cylinders.

12. The baseball bat grip alignment device of claim 11, wherein the at least 6 cylinders are up to 2 mm high and up to 1 mm in diameter.

13. The baseball bat grip alignment device of claim 1, wherein the at least 6 bumps are located at an apex of the convex outer side.

14. The baseball bat grip alignment device of claim 1, wherein the length of the rod is between 229 and 305 mm.

15. The baseball bat grip alignment device of claim 1, wherein a width of the rod is 9.5 mm.

16. The baseball bat grip alignment device of claim 1, wherein a height of the rod is 5 mm.

17. The baseball bat grip alignment device of claim 1, wherein the plurality of slots are 2 mm deep into the convex outer side and 1 mm wide.

18. The baseball bat grip alignment device of claim 1, wherein the plurality of slots are spaced 16 mm apart.

19. The baseball bat grip alignment device of claim 1, wherein the plurality of slots are fully connected with counterpart slots to form a keyway, channel, groove, or hinge-point across the entire concave inner side of the device.

20. The baseball bat grip alignment device of claim 19, wherein the connected keyway, channel, groove, or hinge-point plurality of slots are about 0.5 mm to 1.0 mm wide and 2 mm-3 mm high across the entire concave inner side of the device.

* * * * *